US010646789B1

(12) United States Patent
Esposito

(10) Patent No.: US 10,646,789 B1
(45) Date of Patent: May 12, 2020

(54) HAND CONTROLLED TOY VEHICLE

(71) Applicant: Brian J. Esposito, Tampa, FL (US)

(72) Inventor: Brian J. Esposito, Tampa, FL (US)

( * ) Notice: Subject to any disclaimer, the term of this patent is extended or adjusted under 35 U.S.C. 154(b) by 0 days.

(21) Appl. No.: 16/164,262

(22) Filed: Oct. 18, 2018

(51) Int. Cl.
*A63H 33/30* (2006.01)
*A63H 17/38* (2006.01)
*A63H 17/26* (2006.01)

(52) U.S. Cl.
CPC ..... *A63H 17/38* (2013.01); *A63H 17/262* (2013.01)

(58) Field of Classification Search
CPC ..... A63H 17/38; A63H 17/262
USPC ..... 446/465, 468, 470
See application file for complete search history.

(56) References Cited

U.S. PATENT DOCUMENTS 2,325,109 A * 7/1943 Elmer ..... A63H 33/18 473/588
4,281,472 A * 8/1981 Hill ..... A63H 33/40 446/26
4,366,645 A * 1/1983 Crain ..... A63H 17/38 446/434
4,413,443 A * 11/1983 Kulesza ..... A44C 9/0061 446/26
4,889,514 A * 12/1989 Auer ..... A63H 17/00 446/230
4,938,698 A * 7/1990 Chantry ..... A63B 69/18 434/253
5,906,528 A * 5/1999 Ostendorff ..... A63H 17/02 17/2
6,371,828 B1 * 4/2002 Ngan ..... A63H 17/16 446/327
6,431,943 B1 * 8/2002 Rehkemper ..... A63H 17/16 446/440
6,540,577 B1 * 4/2003 Nelson ..... A63H 33/00 446/129
8,083,565 B1 * 12/2011 Fulton ..... A63H 17/262 446/469
8,550,870 B2 * 10/2013 Laurienzo ..... A63H 17/26 273/109
9,409,098 B2 * 8/2016 Blackham ..... A63H 23/00
9,579,585 B2 2/2017 Silverglate et al.
9,795,892 B2 10/2017 Silverglate et al.
10,245,519 B1 * 4/2019 Spiegel ..... A63H 17/26
2006/0084352 A1 * 4/2006 Johnson ..... A63H 3/14 446/61
2012/0058707 A1 * 3/2012 Finwall ..... A63H 17/38 446/465
2016/0243454 A1 * 8/2016 Laden ..... A63H 27/10

FOREIGN PATENT DOCUMENTS

DE 20-2012-006520 U1 12/2012

OTHER PUBLICATIONS

Modari Cars: Feel the Road, Kickstarter, https://www.kickstarter.com/projects/thoughtfulltoys/modarri-cars-feel-the-road, accessed Jul. 24, 2018.
Handcrafted Mini wooden Jeep 205, Pinterest, https://www.pinterest.co.uk/pin/155303887141898054/?lp=true, accessed Jul. 24, 2018.

* cited by examiner

*Primary Examiner* — Joseph B Baldori
(74) *Attorney, Agent, or Firm* — Young Basile Hanlon & MacFarlane, P.C.

(57) ABSTRACT

There is disclosed a toy vehicle that may be hand controlled by a user, especially a toddler, wherein the hand control is achieved with digit bores that extend into the toy vehicle.

18 Claims, 3 Drawing Sheets

HAND CONTROLLED TOY VEHICLE

FIELD

The present teachings relate generally to a toy. Specifically, a toy vehicle that may be hand controlled by a user.

BACKGROUND

The toy industry has attempted to enhance features of toys in order to make the toys more appealing to users and more specifically children. Conventional toy cars are typically solid and in order to play with the car a user grabs the sides, roof, or rear of the toy car to simulate driving of the vehicle. Pushing the vehicle in this manner provides minimal control and does not provide the user with a connection with the vehicle so that the user is in complete control of the vehicle. Attempts have been made to allow users to control a car from an internal location of the vehicle. An example may be found in U.S. Pat. Nos. 9,579,585 and 9,795,892, the teachings of which are expressly incorporated by reference herein for all purposes. There is a need for a toy vehicle providing for increased tactile dexterity for the users of the toy vehicle. There is a need for a toy vehicle enabling increased control of the toy vehicle to expand modes of play such as the ability to control the vehicle on various terrains. It would be desirable to have a vehicle that allows a user to control the vehicle from a central location.

SUMMARY

The present teachings provide for a toy vehicle comprising: a vehicle body, wheels, one or more digit bores, wherein the one or more digit bores extend into the vehicle body and are configured to accept one or more digits; wherein the one or more digit bores enable a user to manipulate the toy vehicle in a state of play.

The present teachings provide a toy vehicle exhibiting increased control and providing for increased tactile dexterity for the users of the toy vehicle. The present teachings provide a vehicle that allows a user to control the vehicle from a central location.

DETAILED DESCRIPTION

Figure 1:
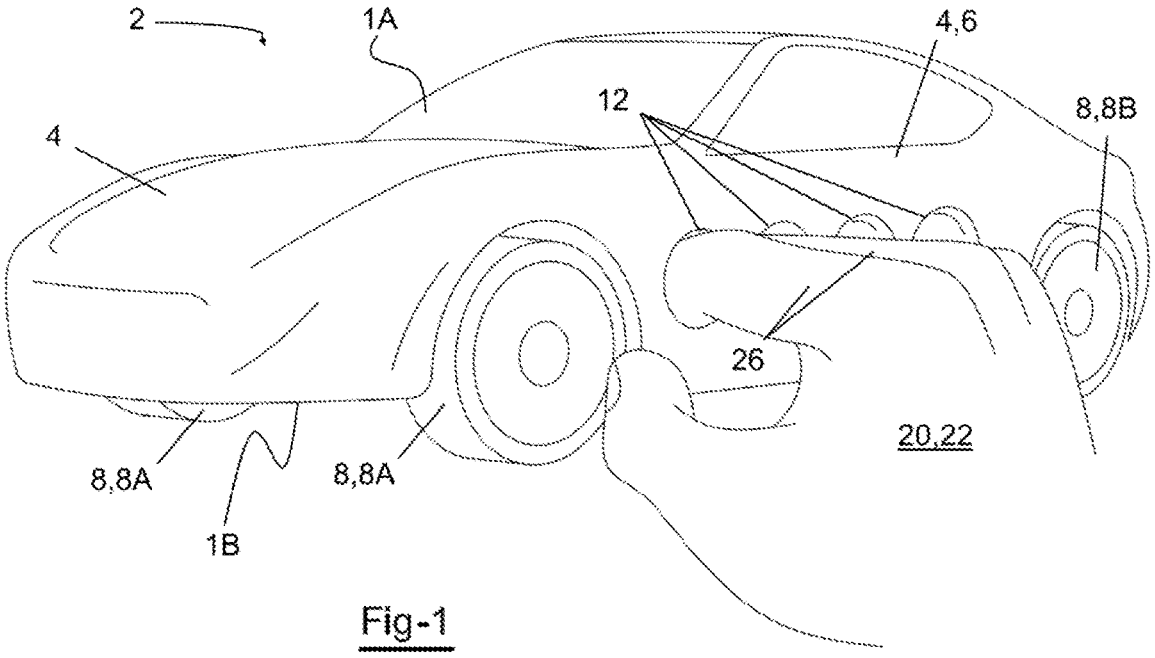
FIG.-1 illustrates a perspective view of a toy vehicle including the hand of a user.

The explanations and illustrations presented herein are intended to acquaint others skilled in the art with the teachings, principles, and practical application of the teachings herein. Those skilled in the art may adapt and apply the teachings in its numerous forms, as may be best suited to the requirements of a particular use. Accordingly, the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The toy vehicle may function as an object of entertainment for a user. The toy vehicle may include a vehicle body, wheels, one or more digit bores, or a combination thereof. The toy vehicle may resemble any type of vehicle, such as a racecar, a construction vehicle, truck, a classic car three-wheeler, UTV, SUV, motorcycle, military vehicle, or a combination thereof. Furthermore, the toy vehicle may resemble things other than vehicles. For example, the toy vehicle may resemble an animal, real or mythical, such as a lion or a dragon. The toy vehicle may be modelled to substantially the same proportions of a particular class of vehicles such as sedans, mid-size SUVs, trucks, or monster trucks. The toy vehicle may be modelled to substantially the same proportions of a particular model of vehicle such as a Ford F-150®, a Chevrolet Corvette®, or perhaps a Ford Mustang®. The toy vehicle may be constructed to a size at which it is manageable and enjoyable for a user to play with the toy vehicle. The toy vehicle may be scaled. The scaling may be about 5% or less, about 3% or less, or about 2% or less the size the commercial vehicle after which the toy vehicle is modelled. The scaling may be about 1% or more. The toy vehicle may be made of wood, polymer (e.g., polyethylene, polypropylene, EVA, polystyrene, acrylonitrile butadiene styrene, Delrin, plasticized PVC, polyurethane, ABS, polycarbonate, HDPE, or a combination thereof), metal (e.g., zinc, aluminum, copper, steel, or a combination thereof), or a combination thereof. A user may generally play with the toy vehicle by inserting one or more digits in the corresponding one or more digit bores and manipulating movement of the toy vehicle, specifically by rolling the toy vehicle across a surface.

The vehicle body may function as a handle or gripping member to a user for manipulating the vehicle in a state of play. The vehicle body may include a cab, a top, a bottom, trunk, hood, or a combination thereof. The cab, trunk portion, and engine bay portion may correspond with the general construction of the commercial vehicle after which the toy vehicle is modelled. The cab generally may be a portion of a vehicle where a driver and passengers are conventionally located. The cab may be located forward of the trunk portion and rearward of the engine bay portion. The cab may also feature windows or features that resemble windows (i.e., either decals or depressions in the material resembling the profile of windows). The bottom may be oriented toward the surface over which the vehicle travels. The top may be oriented substantially parallel to the bottom on an opposing side of the body as the bottom. The exterior surface may be the surface defining the three-dimensional profile of the vehicle body. The vehicle body may include a center of gravity and center planes.

The center of gravity may be a point in the vehicle body at which the weighted relative position of the distributed mass sums to zero. For example, one may be able to balance the toy vehicle on a physical point centered to the center of gravity. The center of gravity may be a point that is substantially centered within the vehicle body. The center of gravity may be a point through which center planes intersect. The center of gravity may be offset from the true geometric center of the vehicle if the profile of the vehicle is uneven or if certain portions of the toy vehicle are heavier than others.

The center planes may function to provide reference geometry for placement of the one or more digit bores. The center planes may be planes that extend through the vehicle body and simultaneously intersect at the center of gravity. The center planes may include a horizontal center plane, a vertical center plane, a transverse center plane, or a combination thereof. The horizontal center plane may substantially bisect the height of the vehicle (i.e., the distance from the bottom of the vehicle to the top of the vehicle). The vertical center plane may substantially bisect the width of the vehicle (i.e., the distance from the right side of the vehicle to the left side of the vehicle). The transverse center plane may substantially bisect the length of the vehicle (i.e., the distance from the front to the back of the vehicle; from the "trunk" to the "engine bay").

The wheels may function to allow the toy vehicle to roll across various surfaces. The wheels may include front wheels and rear wheels. The front wheels may be located forward of the cab and the rear wheels may be located rearward of the cab. The wheels may include bearings, which aid in rotation. The wheels may be rotatable about an axis. The wheels may be connected to the vehicle by an axle, a pin, a nail, or a combination thereof. There may be two or more wheels, four or more wheels, six or more wheels, or even eight or more wheels. The wheels may be constructed from wood, polymer, metal, rubber, a natural material, a synthetic material, or a combination thereof.

The wheel pins may function to provide an axis, around which the wheels rotate. The wheel pins may be molded into the toy vehicle, carved into the toy vehicle, or separate components otherwise attached to the toy vehicle. For example, if the toy vehicle is constructed from polymer, the wheel pins may be molded structures formed at the time the toy vehicle is molded. Alternatively, if the toy vehicle is wooden, the wheel pins may be carved out of the same wooden blank that the vehicle body is carved from. Alternatively, the wheel pins may be metal rods inserted into the toy vehicle during assembly of the toy vehicle and affixed in place either by friction bond, mechanical bond, or chemical bond. Friction bond may refer to a bond in which the wheel pin's diameter is substantially the same as the hole in which it is placed such that force is needed to insert and remove the wheel pin. Mechanical bond may refer to any mechanical means to affix the wheel pin such as a cross-pin, a detent, a snap-lock, or the like. A chemical bond may refer to any chemical fastener such as epoxy, wood glue, cyanoacrylate, hot-melt, or the like. The wheel pins may include a means of fastening the wheels in place. The means for fastening may be a cap, a nut, a circlip, a barbed spring dowel, or the like. The barbed spring dowel may be a dowel that may deform when an object is pushed onto a barb located on the end of the dowel and thereafter return to a lower energy state when said object clears the barb. The wheel pins may extend partially or fully through the wheels.

The user may dictate the movement of the toy vehicle with the user's one or more digits (i.e., a pointer finger, a middle finger, a ring finger, a pinky, and a thumb. The user may be a toddler, a teenager, an adult, or a combination thereof. The user may be a toddler and an adult in the case where a parent is participating in play with their toddler.

The one or more digit bores may function to accept one or more digits of the user. The one or more digit bores may allow the user to manipulate the toy vehicle in a state of play. The one or more digit bores may allow a user to keep control of a toy vehicle in a state of play. For example, instead of grabbing the cab of the toy vehicle, the user may place one or more digits in the one or more digit bores and manipulate the motion of the vehicle. The one or more digit bores may allow a user to drag a car, push a car, or both. The one or more digit bores may allow a user to move the car across virtually any terrain such as hills, mountains, ramps, jumps, fluid, or a combination thereof while the user maintains contact with the vehicle. The one or more digit bores may allow the user to play with the toy vehicle without the user's hands impeding view of the cab of the toy vehicle thereby facilitating imaginative play. The one or more digit bores may be arranged symmetrically, with respect to each other, in the toy vehicle. Specifically, the one or more digit bores may exhibit reflection symmetry, where the plane of reflection is parallel to one of the center planes. Alternatively, the one or more digit bores may exhibit reflection symmetry, where the plane of reflection is biased at an angle to one of the center planes. The digital bores may be configured so that a thumb remains outside of the digital bores. The digital bores may fit one or more digits (i.e., fingers). There may be one or more, two or more, three or more, four or more, or five or more digital bores. There may be four or less digit bores, three or less digit bores, or two or less digit bores. The one or more digital bores may be a single digital bore that fits two or more digits, three or more digits, or even four or more digits. The one or more digital bores may be sufficiently large so that a finger of a 2 year and a finger of an adult may fit within the digital bores. The digital bores my only fit a portion of an adult finger. If the toy vehicle includes only two digit bores, preferably the two digit bores are configured to accept a forefinger and a middle finger. The one or more digit bores may be located on the left side of the vehicle, the right side of the vehicle, may extend from a first side to a second side, extend partially through the vehicle, or located on both sides of the vehicle, where the one or more digit bores extend completely through the vehicle body. The location of the one or more digit bores may correspond to a handedness of the user (i.e., right-handed, left-handed, or ambidextrous). The one or more digit bores may include cross-sectional depth, a cross-sectional length, a bevel, scalloped edges, a gripping member, or a combination thereof. The one or more digit bores may extend into the cab in a straight path, an angled path, or a curved path. Alternatively, the one or more digit bores may extend into the trunk portion. The one or more digit bores may be located in both the cab and the trunk portion, allowing the user a choice of how to play with the toy vehicle.

The straight path may be parallel to the transverse center plane (for digit bores extending into the cab) or the straight path may be parallel to the longitudinal center plane (for digit bores extending into the trunk portion). The angled path may be at an angle with respect to either the transverse center plane (for digit bores extending into the cab), the angled path may be at an angle with respect to the longitudinal center plane (for digit bores extending into the trunk portion), or the angled path may be at an angle with respect to the horizontal axis (for digit bores extending into the cab or the trunk portion). The angle may be plus or minus 45 degrees or less, with respect to the center plane, plus or minus 25 degrees or less, with respect to the center plane, or plus or minus 1 degree or less, with respect to the center plane. The curved path may curve up and away from the horizontal center plane or down and away from the horizontal center plane. The angle or curvature of the one or more digit bores may be the same from bore to bore. The angle or curvature of the one or more digit bores may vary from bore to bore. For example, the paths of the one or more digit bores may flare away from each other as they extend into the cab or the trunk portion.

The depth may be the distance the one or more digit bores extend into the vehicle body. The one or more digit bores may extend partially through the vehicle body or completely through the vehicle body. The one or more digital bores may extend from a first side, a second side, or both sides a distance of about 50 percent or less, 45 percent or less, about 40 percent or less, or about 20 percent or more. Preferably, the one or more digit bores extend fully through the vehicle body. The depth of the one or more digit bores may be the same or different from one of the one or more digit bores to the next. Specifically, the depth of the one or more digit bores may correspond to the relative lengths of the human finger (i.e., a pinky is shorter than a middle finger). The one or more digital bores may have a cross-section that receives the one or more digits so that the one or more digits may extend into the depth of the one or more digital bores.

The cross-section of the one or more digits may function to be a shape that receives one or more digits that are of different shapes and sizes. The cross-section may be the perceived shape of the one or more digit bores when the one or more digit bores are viewed, from the side of the toy (i.e., cross-sectional shape of the one or more digit bores). The cross-section may be any shape such as a circle, oval, hexagon, or square. Preferably, the cross-section is a circle, specifically resembling the cross-sectional shape of human fingers. The cross-sections of adjacent digit bores may overlap, resulting in the one or more digit bores being connected as opposed to discrete channels. For example, the overlap may result in the digital bores being connected and having a common open area but may result in scalloped edges being located between two adjacent bores. Cross-sections that do not overlap result in the one or more digit bores being discrete channels.

The cross-sectional length may be a longest distance of the cross-section (digit bore cross-section), from end-to-end. For example, if the digital bore is a circle then the cross sectional length may be a diameter. The cross-sectional length may correspond to a cross-sectional length of the cross-section of the human finger. Specifically, the cross-sectional length may correspond to the cross-sectional length of a toddler's finger or an adult's finger. Preferably, the cross-sectional length corresponds to the cross-sectional length of a toddler's finger. The cross-sectional length of one of the one or more digit bores may be the same or different from the next. The cross-sectional length of the one or more digit bores may vary from each other in correspondence to the relative cross-sectional length of the finger the one or more digit bores are configured to receive (i.e., a pinky being smaller than a middle finger).

The bevel may function to provide a comfortable feel to the user. The bevel may assist a user in inserting one or more digits into the digital bore. The bevel may increase a cross-sectional length of a digital bore. The bevel may be a sloping edge, defining the transition from the exterior surface to the one or more digit bores. The bevel may extend away from an axis of a digital bore so that a cross-sectional length of the digital bore is increased by the bevel. The bevel may be flat, rounded, one or more chamfers, may be smooth surface, may have one or more edges, or a combination thereof. Preferably, the bevel is rounded. The bevel may assist a user in inserting their digit into a digit bore and a gripping member may assist a user in maintaining their finger in the digital bore or assist a user in moving the toy vehicle.

The gripping member may function to assist a user in moving the vehicle, prevent slippage of one or more digits within a digital bore, or both. The gripping member may function to aid in the tactile dexterity of the user. The gripping member may be a surface within the one or more digit bores that is shaped or textured in a way to provide a grip to the one or more digits of the user. Alternatively, the gripping member may be a material that is sticky or has a high coefficient of friction with respect to the skin of a human finger. The gripping member may comprise ridges, stippling, grit, or the like. Preferably, the gripping member is grit in the form of grip tape. The gripping member may be disposed throughout the whole of the one or more digit bores or the gripping member may be disposed at specific points within the one or more digit bores. Preferably, the gripping member may be disposed, as patches, on a surface of the one or more digit bores oriented toward the bottom of the toy vehicle (i.e., where the pads of the user's one or more digits naturally rest while using the toy vehicle). The gripping member may be located in one of the one or more digit bores or all of the one or more digit bores. The depth within the one or more digit bores at which the gripping members are located may vary in proportion to the length of the requisite finger corresponding to each of the one or more digit bores.

FIG.-1 illustrates a perspective view of a toy vehicle 2 including the hand 22 of a user 20. The toy vehicle 2 has a top 1A and a bottom 1B. The toy vehicle 2 comprises a vehicle body 4 including a cab 6. One or more digit bores 12 extend into the cab 6. One or more digits 26 extend into the one or more digit bores 12. The toy vehicle 2 further comprises wheels 8 including front wheels 8A and rear wheels 8B.

Figure 2:
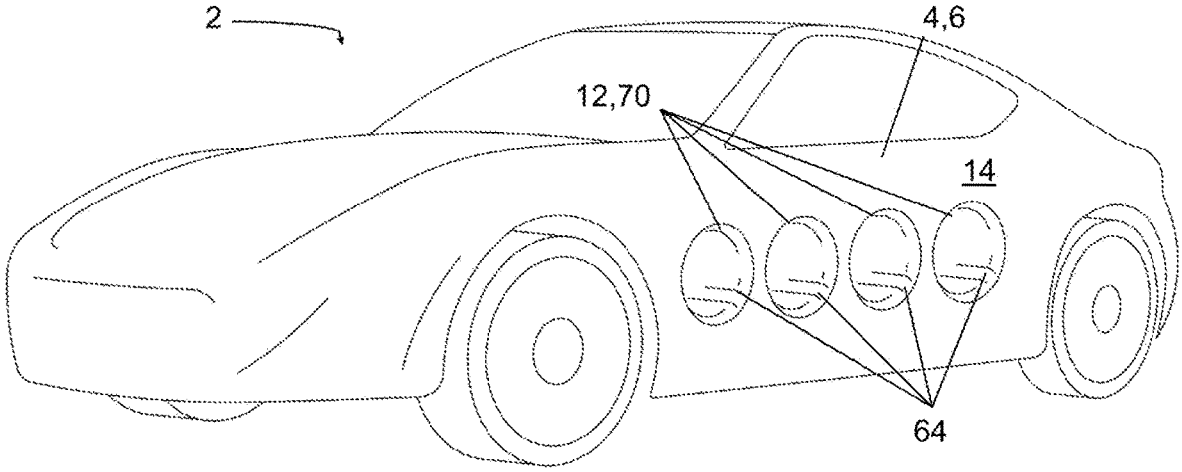
FIG.-2 illustrates a perspective view of a toy vehicle.

FIG.-2 illustrates a perspective view of a toy vehicle 2. The toy vehicle 2 comprises a vehicle body 4 including a cab 6. Four of one or more digit bores 12 extend into the cab 6. The one or more digit bores 12 are discrete channels 70. The toy vehicle 2 further comprises an exterior surface 14. The exterior surface 14 includes bevels 64 where the exterior surface 14 interfaces with the one or more digit bores 12.

Figure 3:
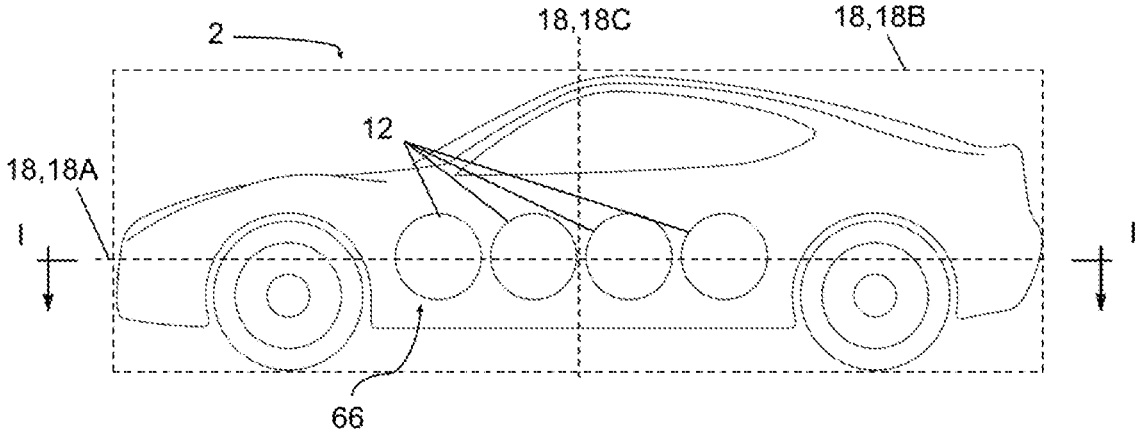
FIG.-3 illustrates a plain side view of a toy vehicle.

FIG.-3 illustrates a plain side view of a toy vehicle 2. The toy vehicle 2 includes one or more digit bores 12. As oriented in FIG.-3, the cross-section 66, which is circular, is displayed. The toy vehicle 2 includes center planes 18 including a horizontal center plane 18A, a vertical center plane 18B, and a transverse center plane 18C. The one or more digit bores 12 are oriented symmetrically with respect to the center of gravity 19. Specifically, the one or more digit bores 12 are oriented with reflective symmetry, equally spaced, fore and aft of the horizontal center plane 18A.

Figure 4:
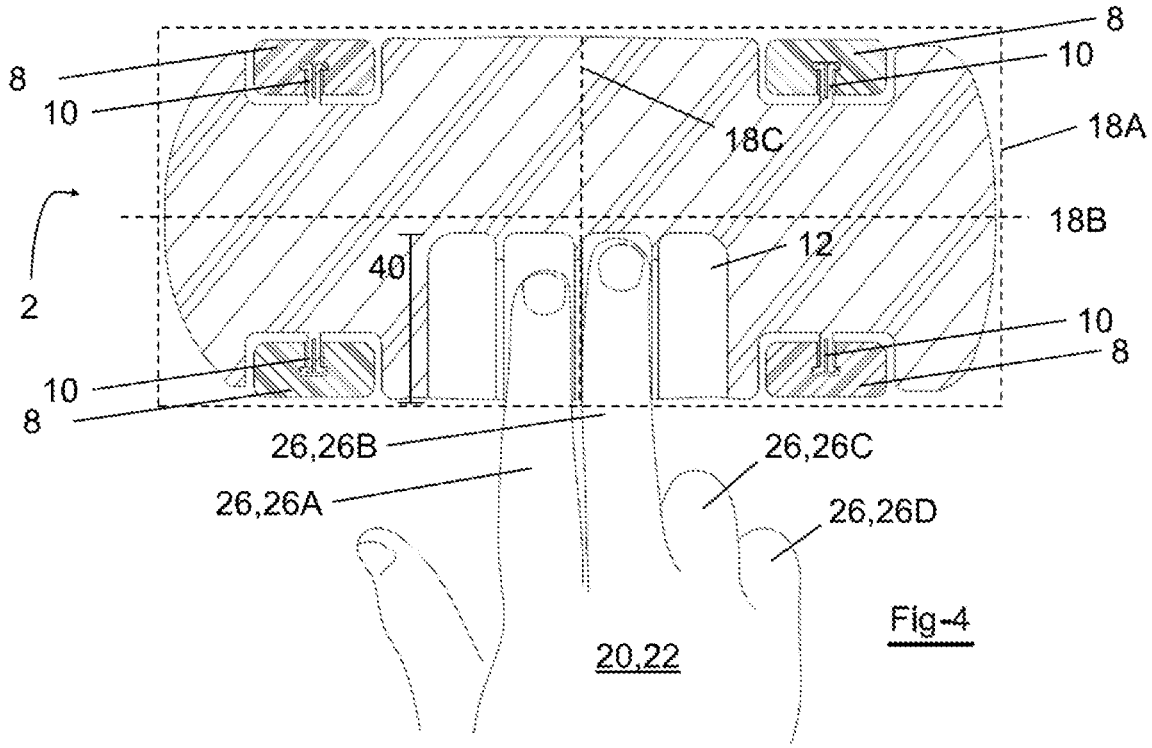
FIG.-4 illustrates a bottom view of a toy vehicle, bisected along line I-I, including the hand of a user.

FIG.-4 is a cross-sectional view of a toy vehicle 2, bisected along line I-I, including the hand 22 of a user 20. The toy vehicle 2 includes four wheel pins 10 and four wheels 8. The wheel pins 10 extend partially through the wheels 8 and the wheels 8 are rotatably fixed on the wheel pins 10. As shown, the wheel pins are barbed spring dowels. The toy vehicle 2 includes a horizontal center plane 18A, a vertical center plane 18B, and a transverse center plane 18C. The toy vehicle 2 further includes one or more digit bores 12. The one or more digit bores 12 extend a depth 40 through the toy vehicle 2. The center axes 44 of the one or more digit bores 12 are aligned in parallel. The hand 22 of the user 20 includes one or more digits 26 including a pointer finger 26A, a middle finger 26B, a ring finger 26C, and a pinky 26D. The pointer finger 26A and the middle finger 26B extends into two of the one or more digit bores 12.

Figure 5:
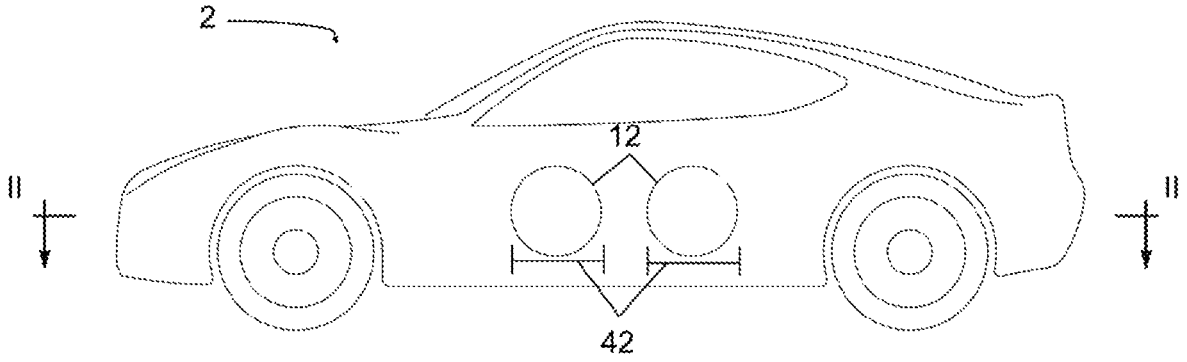
FIG.-5 illustrates a side view of a toy vehicle.

FIG.-5 illustrates a side view of a toy vehicle 2. The toy vehicle 2 includes two of the one or more digit bores 12. The one or more digit bores 12 have a cross-sectional length 42.

Figure 6:
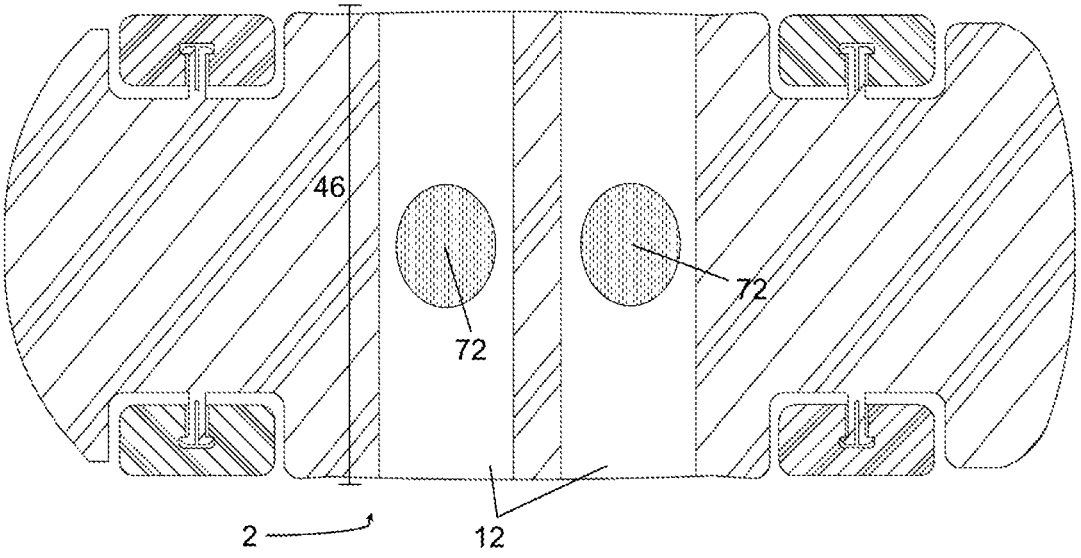
FIG.-6 illustrates a cross-sectional view of a toy vehicle, cut along line II-II.

FIG.-6 illustrates a cross-sectional view of a toy vehicle 2, bisecting along line II-II. The toy vehicle 2 includes two of the one or more digit bores 12 extending a depth 46 completely through the toy vehicle 2. Two gripping members 72 are located within the one or more digit bores 12 on the side of the one or more digit bores 12 facing the bottom (not shown) of the toy vehicle 2.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or consist of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teaching should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

ELEMENT LIST

1A Top
1B Bottom
2 Toy vehicle
4 Vehicle body
6 Cab
8A Wheels
8B Front wheels
8C Rear wheels
10 Wheel pin
12 One or more digit bores
14 Exterior surface
18 Center planes
18A Horizontal center plane
18B Vertical center plane
18C Transverse center plane
19 Center of gravity
20 User
22 Hand
26 One or more digits
26A Pointer finger
26B Middle finger
26C Ring finger
26D Pinky
40 Depth
42 Cross-sectional length
64 Bevel
66 Cross-section
70 Discrete channels
72 Gripping member

I claim:

1. A toy vehicle comprising:

a. a vehicle body including:
   i. a cab having a first side and a second side;
   ii. windows or features that resemble windows;

b. wheels, c. two or more digit bores, wherein the two or more digit bores are blind bores that extend from the first side partially through the vehicle and terminate before reaching the second side of the vehicle body; and d. a center of gravity and a horizontal center plane extending through both the center of gravity and the two or more digit bores;

wherein the two or more digit bores extend into the cab below the windows or features that resemble windows so that a hand of a user extends parallel to or below the horizontal center plane when digits of the user extend into the two or more digit bores, and the two or more digit bores are each configured to accept one of the digits of the user;

wherein the two or more digit bores enable the user to manipulate the toy vehicle in a state of play.

2. The toy vehicle of claim 1, wherein the toy vehicle is a racecar, a construction vehicle, or a classic car.

3. The toy vehicle of claim 1, wherein the wheels include front wheels and rear wheels and the cab is located between the front wheels and the rear wheels.

4. The toy vehicle of claim 1, wherein the vehicle body includes:

a. an exterior surface, which defines a three-dimensional profile of the vehicle body, and b. a bevel where the exterior surface interfaces with the one or more digit bores.

5. The toy vehicle of claim 1, wherein each of the two or more digit bores form discrete channels that extend parallel to one another into the vehicle body from the first side.

6. The toy vehicle of claim 1, wherein the two or more digit bores are discrete from one another and are located side-by-side and extend in a direction parallel to one another.

7. The toy vehicle of claim 1, wherein the center of gravity is located at the intersection of center planes including the horizontal center plane, a vertical center plane, and a transverse center plane.

8. The toy vehicle of claim 7, wherein the two or more digit bores are arranged in accordance with reflection symmetry, where a plane of reflection is parallel to one of the horizontal center plane, vertical center plane, or transverse center plane.

9. The toy vehicle of claim 8, wherein the two or more digit bores are arranged, equally spaced fore and aft of the transverse center plane.

10. The toy vehicle of claim 1, wherein a first of the two or more digit bores is configured to accept a pointer finger of a first hand and a second of the two or more digit bores is configured to accept a middle finger of the first hand.

11. The toy vehicle of claim 1, wherein the two or more digital bores extend into the vehicle body a distance of 50 percent or less of a width of the vehicle body.

12. A toy vehicle comprising:

a. a vehicle body including:

i. a cab having a first side and a second side;

ii. windows or features that resemble windows;

b. wheels, c. four or more digit bores, wherein the four or more digit bores are blind bores that extend from the first side partially through the vehicle and terminate before reaching the second side of the vehicle body; and d. a center of gravity and a horizontal center plane extending through both the center of gravity and the four or more digit bores;

wherein the four or more digit bores extend into the cab below the windows or features that resemble windows so that a hand of a user extends parallel to or below the horizontal center plane when digits of the user extend into the four or more digit bores, and the four or more digit bores are each configured to accept one of the digits of the user;

wherein the four or more digit bores enable the user to manipulate the toy vehicle in a state of play; and wherein a first of the four or more digit bores is configured to accept a pointer finger; a second of the four or more digit bores is configured to accept a middle finger; a third of the four or more digit bores is configured to accept a ring finger; and a fourth of the four or more digit bores is configured to accept a pinky.

13. The toy vehicle of claim 12, wherein the four or more digit bores includes a gripping member oriented toward a bottom of the toy vehicle.

14. The toy vehicle of claim 13, wherein the gripping member comprises a textured pad.

15. The toy vehicle of claim 12, wherein the four or more digit bores have a cross-sectional length that is sufficiently large to accommodate toddler fingers.

16. The toy vehicle of claim 12, wherein the four or more digit bores are symmetrically located with respect to the center of gravity.

17. The toy vehicle of claim 12, wherein the four or more digital bores extend into the vehicle body a distance of 50 percent or less of a width of the vehicle body.

18. The toy vehicle of claim 17, wherein the four or more digital bores are equally spaced apart along a horizontal center plane.

* * * * *